US008440138B1

(12) United States Patent
Standifer et al.

(10) Patent No.: US 8,440,138 B1
(45) Date of Patent: May 14, 2013

(54) ODOR NEUTRALIZING SHOE INSERT AND ASSOCIATED METHOD

(76) Inventors: Curtis Standifer, Decatur, GA (US); Selena Moore, Decatur, GA (US)

( * ) Notice: Subject to any disclaimer, the term of this patent is extended or adjusted under 35 U.S.C. 154(b) by 330 days.

(21) Appl. No.: 12/902,885

(22) Filed: Oct. 12, 2010

Related U.S. Application Data

(60) Provisional application No. 61/250,672, filed on Oct. 12, 2009.

(51) Int. Cl.
*A61L 9/00* (2006.01)
*A43B 13/38* (2006.01)

(52) U.S. Cl.
USPC ..... 422/5; 36/44

(58) Field of Classification Search ..... 422/5; 36/44
See application file for complete search history.

(56) References Cited

U.S. PATENT DOCUMENTS

| | | | | |
|---|---|---|---|---|
| 5,543,157 | A | 8/1996 | Trinh | |
| 6,185,844 | B1 * | 2/2001 | Janzen | 36/3 B |
| 6,209,228 | B1 | 4/2001 | Yang | |
| 2002/0066209 | A1 * | 6/2002 | Steed et al. | 36/44 |
| 2003/0041808 | A1 * | 3/2003 | Wulforst et al. | 119/28.5 |
| 2004/0037792 | A1 | 2/2004 | Hiramoto | |

* cited by examiner

*Primary Examiner* — Kevin Joyner

(57) ABSTRACT

An odor neutralizing shoe insert includes a flexible top layer formed from a fluid-absorbent material and a flexible bottom layer spaced from the top layer. An intermediate layer impregnated with a plurality of ground coffee particulates may be intercalated between the top and bottom layers respectively. The top layer may include a plurality of apertures formed through its entire cross-section such that the top layer is in fluid communication with the ground coffee particulates. The ground coffee particulates may further be scattered along a major top surface area of the intermediate layer and thereby filter through the top layer such that the ground coffee particulates become exposed above the top layer.

11 Claims, 4 Drawing Sheets

ODOR NEUTRALIZING SHOE INSERT AND ASSOCIATED METHOD

CROSS REFERENCE TO RELATED APPLICATIONS

This application claims the benefit of U.S. Provisional Application No. 61/250,672, filed Oct. 12, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to odor neutralizing shoe inserts and, Amore particularly, to an odor absorbing and neutralizing shoe insert that utilizes coffee for providing users with a convenient and effective means of reducing foot odor in shoes.

2. Prior Art

Perspiration is a fact of life. In simple terms, perspiration is the evaporation of sweat through thousands of sweat glands located all over the body. Serving to control body temperature by cooling the skin, perspiration is a natural process, necessary in maintaining optimal health. Occurring during activity or even when the body is at rest, perspiration can also be triggered by nervousness, excitement, anxiety or fear. Whether running a marathon or simply reading a book, excessive perspiration can leave a person feeling uncomfortable, wet and unclean.

In particular, perspiration on the back of the feet can not only result in discomfort, but can create a pungent odor that can be both unpleasant and embarrassing. Foot odor often results from wearing shoes and/or socks, especially shoes or socks with inadequate air ventilation, for many hours. Since human feet are densely covered with sweat glands, excessive perspiration of the feet is the result. This perspiration and warmth provide ideal conditions for bacteria and or fungi to thrive.

The presence of the bacteria and/or fungi does not in and of itself cause odor; instead, as the bacteria consume dead skin cells and moisture, they in turn produce waste material. This waste material is the cause of foot odor. As physical activity increases, foot perspiration, bacterial growth, and bacterial waste production all increase, causing odor to intensify. Although chemical based deodorizers may be used to combat these odors, these types of products may not be suitable for people who may have allergic reactions to certain types of chemicals.

Accordingly, a need remains for an apparatus in order to overcome the above-noted shortcomings. The present invention satisfies such a need by providing an odor absorbing shoe inserts that is convenient and easy to use, lightweight yet durable in design, versatile in its applications, and designed for providing a user with a convenient and effective means of reducing foot odor in shoes.

BRIEF SUMMARY OF THE INVENTION

In view of the foregoing background, it is therefore an object of the present invention to provide an apparatus for eliminating foul aroma from footwear. These and other objects, features, and advantages of the invention are provided by an odor neutralizing shoe insert.

The odor neutralizing shoe insert may include a flexible top layer formed from a fluid-absorbent material and a flexible bottom layer spaced from the top layer. An intermediate layer impregnated with a plurality of ground coffee particulates impregnated may be intercalated between the top and bottom layers respectively. The ground coffee particulates may further be scattered along a major top surface area of the intermediate layer and thereby filter through the top layer such that the ground coffee particulates become exposed above the top layer.

The top layer may include a plurality of apertures formed through its entire cross-section such that the top layer is in fluid communication with the ground coffee particulates. Such an arrangement provides the unexpected and unpredictable advantage of sandwiching the coffee particulates between the top and bottom layers in a secured environment while at the same time allowing the ground coffee particulates an avenue to penetrate through the top layer to eliminate the foul aroma from the footwear effectively.

A plurality of adhesive layers may cover the entire top surface area as well as a bottom surface area of the intermediate layer. In this way, selected ones of the ground coffee particulates may adhere to the adhesive layers and remain located exterior of the intermediate layer. Such an arrangement provides the unexpected and unpredictable advantage of securing the ground coffee particulates permanently throughout the top and bottom surface areas of the intermediate layer thereby covering the entire area of the shoe where the sole of the user's foot may be in contact with.

The intermediate layer may further include a plurality of linear troughs juxtaposed along the top surface area in such a manner that selected ones of the ground coffee particulates are countersunk within the linear troughs and displaced along the linear troughs when an external force acts on the top layer. The intermediate layer may further include a plurality of linear crests intermediately located between the linear troughs such that a first group of the ground coffee particulates are situated on top of the linear crests and displaced upwardly through the apertures when an external force is exerted on the top layer.

A second group of the ground coffee particulates may be deposited into the linear troughs. Such an arrangement provides the unexpected and unpredictable advantage of keeping the ground coffee particulates within the troughs when the apparatus is compressed and extended during walking movements. The pumping action of the compression and extension of the top, intermediate and bottom layers also produces a suction action to push the second group of the ground coffee particulates through the apertures of the top layer to effectively eliminate the odor of the user's foot.

The intermediate and top layers may further be coextensively shaped and adapted to be placed within the shoe together with the bottom layer. Such an arrangement provides the unexpected and unpredictable advantage of easily and conveniently inserting the apparatus within the interior of the shoe.

The invention may include a method of utilizing an odor neutralizing shoe insert for eliminating foul aroma from footwear. Such a method may include the chronological steps of: providing a flexible top layer formed from fluid-absorbent material; providing a flexible bottom layer spaced from said top layer; providing an intermediate layer and a plurality of ground coffee particulates; impregnating an initial portion of said ground coffee particulates within said intermediate layer; scattering a remaining portion of said ground coffee particulates along a major top surface area of said intermediate layer; intercalating said intermediate layer between said top and bottom layers; positioning said top, intermediate and bottom layers into a shoe; and exposing said ground coffee particulates above said top layer by filtering said ground coffee particulates through said top layer during walking procedures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
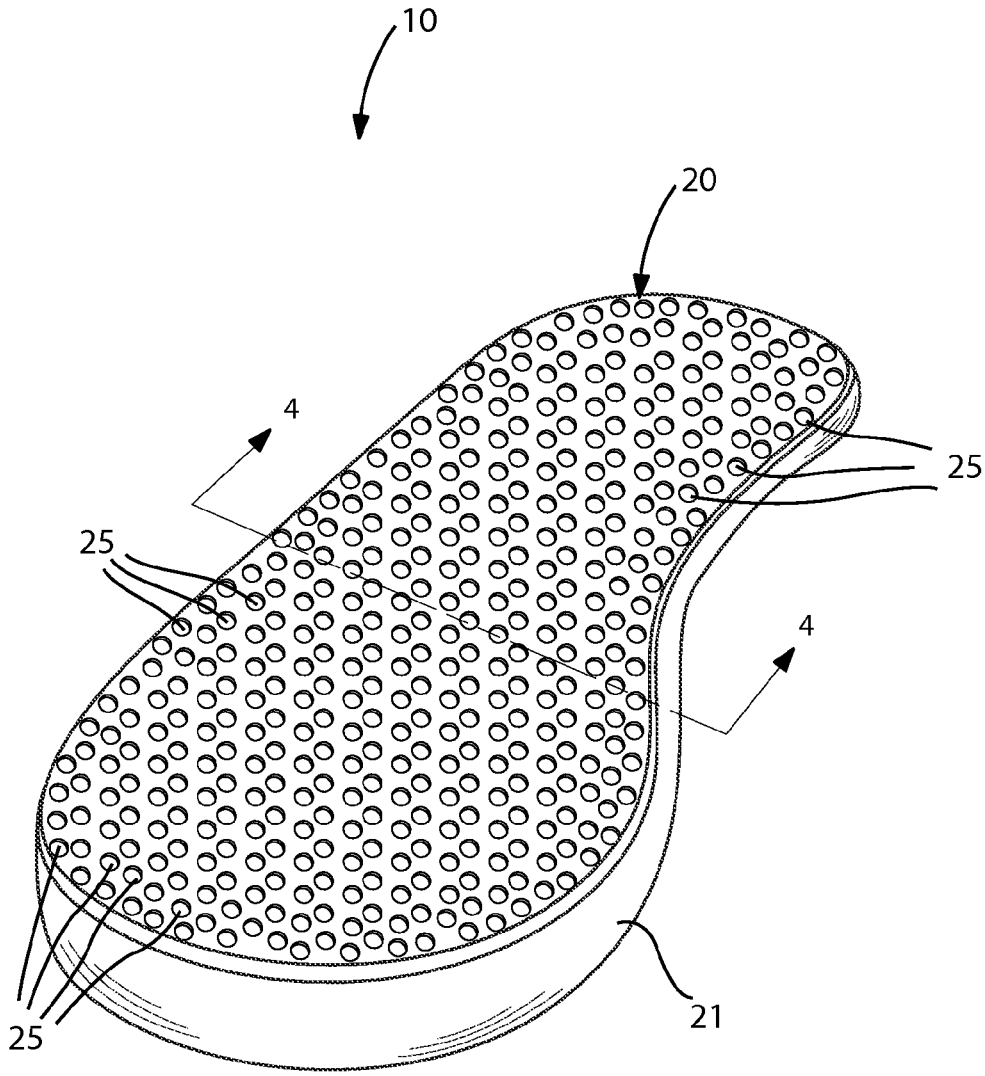
FIG. 1 is a perspective view showing an odor neutralizing shoe insert, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-5 by the reference numeral 10 and is intended to provide an odor neutralizing shoe insert. It should be understood that the odor neutralizing insert 10 may be used to eliminate foul aroma from a variety of footwear and is not limited to be used with any particular type of footwear.

Referring to FIGS. 1-5 in general, the odor neutralizing shoe insert 10 may include a flexible top layer 20 formed from a fluid-absorbent material and a flexible bottom layer 21 spaced from the top layer 20. A variety of conventional fluid-absorbent and flexible materials may be employed without departing from the true scope of the present invention. An intermediate layer 22 is advantageously impregnated with a plurality of ground coffee particulates 23 and may be intercalated between the top and bottom layers 20, 21, respectively. As a non-limiting example, the intermediate layer 22 may be formed from porous material for releasably receiving the ground coffee particulates therein. The ground coffee particulates 23 may be impregnated into the intermediate layer 22 via a variety of conventional methods, well known in the industry. For example, U.S. Pat. No. 5,043,172 discloses a method for impregnating a flavored insert to be placed within a coffee filter, and U.S. Pat. No. 5,518,743 discloses a method of impregnating an essential oil into a coffee filter.

Figure 4:
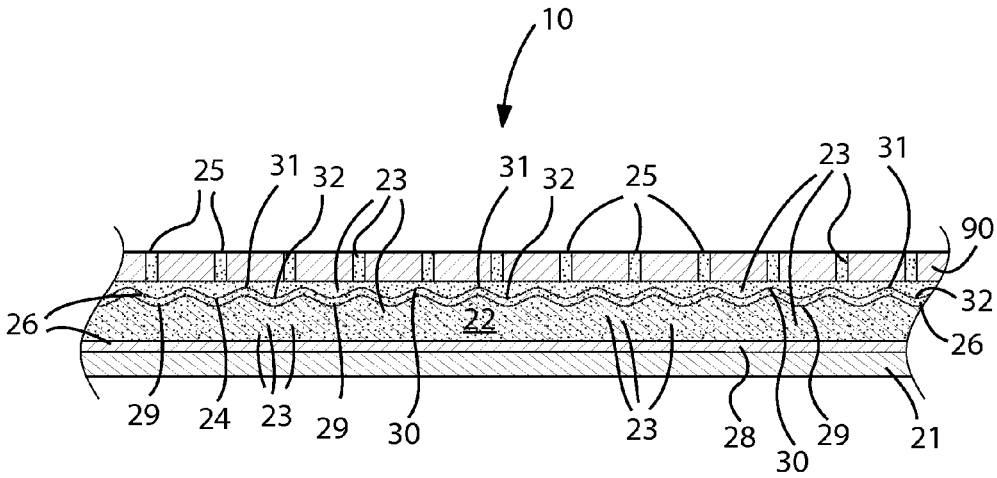
FIG. 4 is a cross-sectional view taken along line 4-4 showing a non-limiting embodiment wherein the ground coffee particulates are sprinkled within crests and troughs of the intermediate layer and travel upwardly through the top layer.
Figure 5:
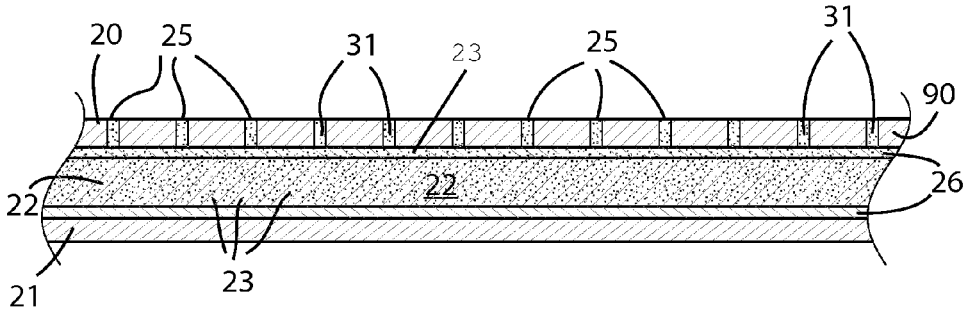
FIG. 5 a cross-sectional view taken along line 4-4 showing a non-limiting embodiment wherein the ground coffee particulates are sprinkled on a top adhesive layer and travel upwardly through the top layer.

As non-limiting examples perhaps best shown in FIGS. 4 and 5, the ground coffee particulates 23 may be scattered along a major top surface area 24 of the intermediate layer 22 and thereby filtered through the top layer 20 such that the ground coffee particulates 23 become exposed above the top layer 20. Thus, the top layer 20 may include a plurality of apertures 25 formed through its entire cross-section 90 (FIGS. 4 and 5) such that the top layer 20 is in fluid communication with the ground coffee particulates 23. Such a structural configuration provides the unexpected and unpredictable advantage of sandwiching the ground coffee particulates 23 between the top and bottom layers 20, 21 in a secured environment (to limit coffee aroma from escaping thru the footwear during non-use) while at the same time allowing the ground coffee particulates 23 direct and efficient travel path to penetrate through the top layer 20 and eliminate foul aroma from the footwear (especially during walking and running conditions).

By maintaining most of the ground coffee particulates 23 within the intermediate layer 22, and thereafter selectively exposing the ground coffee particulates during walking and running conditions, the neutralizing effect of the ground coffee particulates 23 is maximized during walking and running conditions and minimizing during non-use conditions. Such a result advantageously extends the useful life of the shoe sole and alleviates the need for frequent replacement of the shoe sole.

As a non-limiting example perhaps best shown in FIG. 5, a plurality of adhesive layers 26 may cover the entire top surface area 24 as well as a bottom surface area 28 of the intermediate layer 22, respectively. In this way, selected ones of the ground coffee particulates 23 may adhere to the adhesive layers 26 and remain located exterior of the intermediate layer 22. Such a structural configuration provides the unexpected and unpredictable advantage of securing at least a portion of the ground coffee particulates 23 throughout the top and bottom surface areas 24, 28 of the intermediate layer 22 such that all the ground coffee particulates 23 are not discharged from apertures 25.

Figure 2:
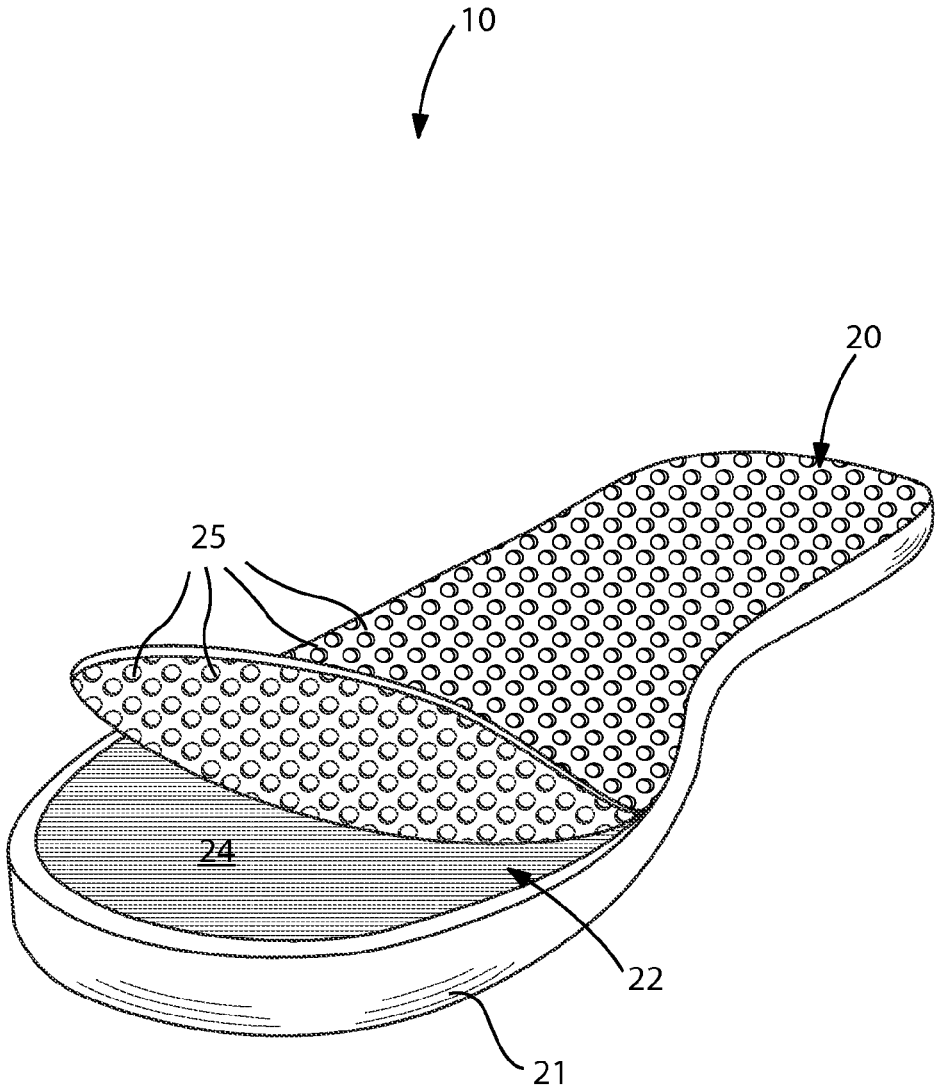
FIG. 2 is another perspective view of the shoe insert showing the intermediate layer intercalated between the top and bottom layers respectively.

As perhaps best shown in FIGS. 2 and 4, the intermediate layer 22 may have a sinusoidal (curvilinear) shape including a plurality of linear troughs 29 juxtaposed along the top surface area 24 of the intermediate layer 22. The troughs 29 linearly extends along the intermediate layer 22 (FIG. 2) in such a manner that selected ones of the ground coffee particulates 23 are countersunk within the linear troughs 29 and displaced along the linear troughs 29 when an external force acts on the top layer 20. For example, when a user is walking/running, some ground coffee particulates 23 are urged along the linear troughs 22 due to the pressure exerted on the shoe sole 10 by the user's foot.

Still referring to FIGS. 2 and 4, the intermediate layer 22 may further include a plurality of linear crests 30 intermediately located between the linear troughs 29 such that a first group 31 of the ground coffee particulates 23 are situated on top of the linear crests 30 and displaced upwardly thru apertures 25 when an external force is exerted on the top layer 20 (such as walking/running forces). A second group 32 of the ground coffee particulates 23 may be deposited into the linear troughs 29 and thereby channeled along the linear troughs 29 and disbursed along the surface area of the intermediate layer 22. Such an arrangement provides the unexpected and unpredictable advantage of keeping the ground coffee particulates 23 within the troughs 29 (extends the useful life of the shoe sole) when the shoe sole 10 is compressed and extended during walking/running conditions. The repeated pumping action of the compression and extension of the top, intermediate and bottom layers 20, 22, 21 advantageously creates a suction action to push the second group 32 of ground coffee particulates 23 through the apertures 25 of the top layer 20 and effectively eliminate the foul odors. For example, when one portion of the user's foot presses on the top layer 20, some of the apertures 25 are compressed/covered while others remain expanded/exposed so that the ground coffee particulate groups 31 are interchangeably discharged through apertures 25.

Figure 3:
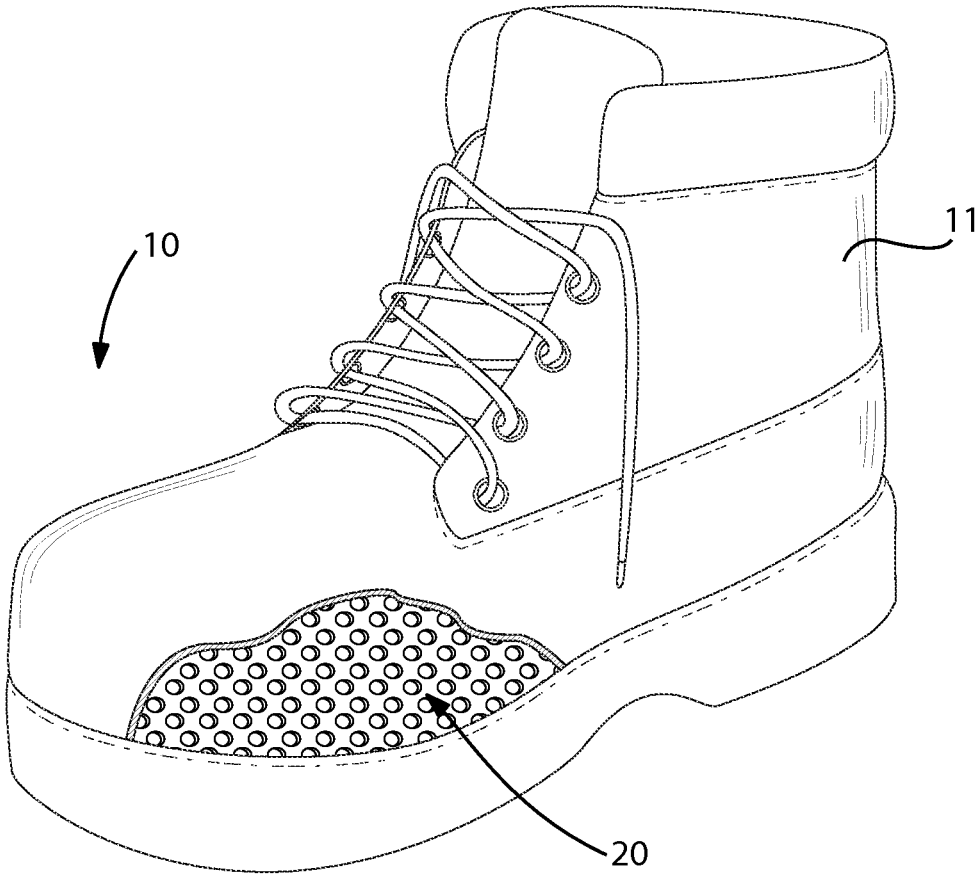
FIG. 3 is a partially exposed view of the shoe insert positioned inside a shoe.

FIGS. 1-3 show the intermediate and top layers 22, 20 coextensively shaped and adapted to be placed within the shoe 11 together with the bottom layer 21. Such an arrangement provides the unexpected and unpredictable advantage of easily and conveniently inserting the apparatus 10 within the interior of the shoe 11.

The present disclosure may further include a method of utilizing an odor neutralizing shoe insert 10 for eliminating foul aroma from footwear. Such a method may include the chronological steps of: providing a flexible top layer 20 formed from fluid-absorbent material; providing a flexible bottom layer 21 spaced from the top layer 20; providing an intermediate layer 22 and a plurality of ground coffee particulates 23; impregnating an initial portion of the ground coffee particulates 23 within the intermediate layer 22; scattering a remaining portion of the ground coffee particulates 23 along a major top surface area 24 of the intermediate layer 22; intercalating the intermediate layer 22 between the top and bottom layers 20, 21; positioning the top, intermediate and bottom layers 20, 22, 21 into a shoe 11; and exposing the ground coffee particulates 23 above the top layer 20 by filtering the ground coffee particulates 23 through the top layer 20 during walking/running procedures.

As a non-limiting example, the various layers may be manufactured of sanitary paper material or other suite porous materials. The ground coffee particulates 23 may be sprinkled along the intermediate layer 22 via a conventional adhesive that can adhere to the surface of the intermediate layer 22. The odor absorbing shoe inserts 10 with the ground coffee particulates 23 thus neutralizes and absorbs odors thus sparing users the embarrassment and discomfort associated with removing their shoes in front of friends or loved ones.

In an alternative embodiment, the apparatus 10 may feature a raised portion to provide support for the arches of users' feet. The apparatus 10 may further feature portions with textured surface to provide extra comfort for the user.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. An odor neutralizing shoe insert for eliminating foul aroma from footwear, said odor neutralizing shoe insert comprising:

a top layer;

a bottom layer spaced from said top layer; and an intermediate layer intercalated between said top and bottom layers;

wherein said intermediate layer includes a plurality of ground coffee particulates impregnated therein;

wherein said ground coffee particulates are further scattered along a major top surface area of said intermediate layer and thereby filter through said top layer such that said ground coffee particulates become exposed above said top layer;

wherein said intermediate layer further comprises: a plurality of linear troughs juxtaposed along said top surface area, selected ones of said ground coffee particulates being countersunk within said linear troughs and displaced along said linear troughs when an external force acts on said top layer.

2. The odor neutralizing shoe insert of claim 1, wherein said top layer includes a plurality of apertures formed through an entire cross-section thereof such that said top layer is in fluid communication with said ground coffee particulates.

3. The odor neutralizing shoe insert of claim 1, further comprising: a plurality of adhesive layers entirely covering said top surface area as well as a bottom surface area of said intermediate layer, wherein selected ones of said ground coffee particulates are adhered to said adhesive layers and remain located exterior of said intermediate layer.

4. The odor neutralizing shoe insert of claim 1, wherein said intermediate layer further comprises: a plurality of linear crests intermediately located between said linear troughs, a first group of said ground coffee particulates being situated on top of said linear crests and displaced upwardly through said apertures when an external force is exerted on said top layer, a second group of said ground coffee particulates being deposited into said linear troughs.

5. The odor neutralizing shoe insert of claim 1, wherein said intermediate and top layers are coextensively shaped and adapted to be placed within the shoe together with said bottom layer.

6. An odor neutralizing shoe insert for eliminating foul aroma from footwear, said odor neutralizing shoe insert comprising:

a flexible top layer formed from fluid-absorbent material;

a flexible bottom layer spaced from said top layer; and an intermediate layer intercalated between said top and bottom layers;

wherein said intermediate layer includes a plurality of ground coffee particulates impregnated therein;

wherein said ground coffee particulates are further scattered along a major top surface area of said intermediate layer and thereby filter through said top layer such that said ground coffee particulates become exposed above said top layer;

wherein said intermediate layer further comprises: a plurality of linear troughs juxtaposed along said top surface area, selected ones of said ground coffee particulates being countersunk within said linear troughs and displaced along said linear troughs when an external force acts on said top layer.

7. The odor neutralizing shoe insert of claim 6, wherein said top layer includes a plurality of apertures formed through an entire cross-section thereof such that said top layer is in fluid communication with said ground coffee particulates.

8. The odor neutralizing shoe insert of claim 6, further comprising: a plurality of adhesive layers entirely covering said top surface area as well as a bottom surface area of said intermediate layer, wherein selected ones of said ground coffee particulates are adhered to said adhesive layers and remain located exterior of said intermediate layer.

9. The odor neutralizing shoe insert of claim 6, wherein said intermediate layer further comprises: a plurality of linear crests intermediately located between said linear troughs, a first group of said ground coffee particulates being situated on top of said linear crests and displaced upwardly through said apertures when an external force is exerted on said top layer, a second group of said ground coffee particulates being deposited into said linear troughs.

10. The odor neutralizing shoe insert of claim 6, wherein said intermediate and top layers are coextensively shaped and adapted to be placed within the shoe together with said bottom layer.

11. A method of utilizing an odor neutralizing shoe insert for eliminating foul aroma from footwear, said method comprising the chronological steps of:

providing a flexible top layer formed from fluid-absorbent material;

providing a flexible bottom layer spaced from said top layer;

providing an intermediate layer and a plurality of ground coffee particulates;

impregnating an initial portion of said ground coffee particulates within said intermediate layer;

scattering a remaining portion of said ground coffee particulates along a major top surface area of said intermediate layer;

intercalating said intermediate layer between said top and bottom layers;

positioning said top, intermediate and bottom layers into a shoe; and exposing said ground coffee particulates above said top layer by filtering said ground coffee particulates through said top layer during walking procedures;

wherein said intermediate layer further comprises: a plurality of linear troughs juxtaposed along said top surface area, selected ones of said ground coffee particulates being countersunk within said linear troughs and displaced along said linear troughs when an external force acts on said top layer.

* * * * *